US005385652A

United States Patent [19]

Wang et al.

[11] Patent Number: 5,385,652

[45] Date of Patent: Jan. 31, 1995

[54] METHOD OF ETCHING USING A SILVER/SILVER OXIDE REFERENCE ELECTRODE

[75] Inventors: Su-Chee S. Wang, Troy, Mich.; Dan W. Chilcott, Sharpsville, Ind.

[73] Assignee: Delco Electronics Corporation, Kokomo, Ind.

[21] Appl. No.: 168,328

[22] Filed: Dec. 17, 1993

[51] Int. Cl.[6] ..... C23F 3/00

[52] U.S. Cl. ..... 204/129.25; 204/129.1; 204/129.75; 156/627

[58] Field of Search ..... 156/627, 626, 662; 204/129.2, 129.25, 129.1, 129.75

[56] References Cited

U.S. PATENT DOCUMENTS 5,173,149 12/1992 Nojiri et al. ..... 156/626 X

FOREIGN PATENT DOCUMENTS 154350 9/1984 Japan .

18259 1/1988 Japan .

OTHER PUBLICATIONS

Newman, John S., Electrochemical Systems, Prentice-Hall, 1973, pp. 107-123.

*Primary Examiner*—Thi Dang

*Attorney, Agent, or Firm*—Cary W. Brooks; Jimmy L. Funke

[57] ABSTRACT

Generally, the invention includes a method of wet electrochemical etching of a substrate with an anisotropic etchant using a silver/silver oxide ($Ag/Ag_2O$) reference electrode. The silver/silver oxide reference electrode can be used with electrochemical etch-stop techniques to fabricate a variety of semiconductor devices including microsensors and microactuator in a variety of anisotropic etchants. The silver/silver oxide reference electrode eliminates the need to use glass or plastic tubes.

6 Claims, 3 Drawing Sheets

METHOD OF ETCHING USING A SILVER/SILVER OXIDE REFERENCE ELECTRODE

FIELD OF THE INVENTION

This invention relates to a method of making a wet electrochemical etch-stop, and more particularly to etching with a silver/silver oxide reference electrode.

BACKGROUND OF THE INVENTION

The electrochemical etch-stop technique is an attractive method for fabricating microsensors and microactuators since it has the potential for allowing one to reproducibly fabricate moderately-doped n-type silicon microstructures with good thickness control. A number of investigators have reported on the fabrication of silicon microstructures using electrochemical etch-stopping in various anisotropic etchants (KOH, ethylenediamine pyrocatechol, and hydrazine). The term "anisotropic etchant" means, in these etchant the (111) silicon plane etches very slowly compared to both (100) and (110) plane.

The working principle of the conventional junction electrochemical etch-stop technique is illustrated in FIG. 1A which shows the three-electrode etching configuration for fabricating silicon membranes. The three electrodes are: a (100) Si wafer working electrode 10 with a p-n junction 12 formed at the interface of a p-layer 14 and an n-layer 16, a platinum counterelectrode 18, and a reference electrode 20. A mask 22 is selectively formed on the Si wafer. The electrodes are submerged in a wet etchant 24 within a container 26. A constant positive bias voltage is applied to the silicon wafer with respect to the reference electrode. Due to the presence of the reverse-bias junction, no current can flow to the p-layer and it will not be affected by the bias voltage. Therefore, the p-layer will be anisotropically etched. The term "anisotropically etched" means etching only proceeds in the direction perpendicular to the surface of the silicon wafer, i.e., in the (100) direction, but does not proceed in one direction parallel to the surface, (111) direction (as illustrated in FIG. 1B). As soon as the p-layer is etched off and the n-layer is exposed to the etchant (FIG. 1B), the n-layer will be passivated by the constant positive bias voltage and etching will stop. A thin moderately-doped n-type membrane is thus formed.

A major challenge in using electrochemical etch-stop is to maintain the positive bias voltage applied to the silicon wafer sufficiently anodic to passivate the entire n-layer, so that the yield of this process can be maximized. In order to precisely control the amplitude of the positive bias voltage, a reference electrode is needed (see FIGS. 1A and 1B).

A reference electrode consists of a metal and a compound of the same metal, with which a very reproducible equilibrium potential can be established. When a reference electrode is used in the electrochemical etch system (FIG. 1A), the potential difference between the silicon working electrode and the reference electrode is continuously measured and feedbacked to the control system (a potentiostat). Therefore, the positive bias voltage applied to the silicon wafer can be precisely controlled.

Commercially available reference electrodes, such as silver-silver chloride (Ag/AgCl) 28 and mercury/mercury oxide (Hg/HgO), are contained inside glass or plastic tubes 30. The tubes are filled with special electrolytes 32 such as KCl (see FIG. 2). A porous glass fret 34 was then used to connect the internal electrolyte to the etchant 36. The reasons why separate tubes are needed for the reference electrodes are described as follows.

For the Ag/AgCl reference electrode 28, potassium chloride electrolyte 32 is necessary to establish a reproducible equilibrium potential between silver and silver chloride, and the pair is not stable in the caustic etchants used for the electrochemical etch-stop process. Therefore, the Ag/AgCl reference electrode has to be contained inside a separate tube 30 filled up with potassium chloride electrolyte. For the mercury/mercury oxide reference electrode, the pair is able to establish a stable equilibrium potential in caustic etchants. However, mercury is considered as a hazardous material, and it is desirable to contain such hazardous material in a separate tube.

If a Ag/AgCl or Hg/HgO reference electrode is used for the electrochemical etch-stop process, the caustic etchant used to etch the silicon will gradually degrade the glass fret. Eventually the glass fret will disintegrate, and the reference electrode needs to be replaced. Continuously monitoring the condition of a reference electrode could be troublesome for mass producing silicon microstructures using the electrochemical etch-stop process. Therefore, a relatively maintenance free reference electrode, i.e., without using a glass tube and fret, is desirable.

The present invention overcomes the problems in the prior art.

SUMMARY OF THE INVENTION

Generally, the invention includes a method of wet electrochemical etch-stop of a substrate with an anisotropic etchant using a silver/silver oxide ($Ag/Ag_2O$) reference electrode. The silver/silver oxide reference electrode can be used with electrochemical etch-stop techniques to fabricate a variety of semiconductor devices including microsensors and microactuator in a variety of anisotropic etchants. The silver/silver oxide reference electrode eliminates the need to use glass or plastic tubes.

These and other objects, features and advantages of the present invention will be apparent from the following brief description of the drawing, detailed description and appended claims and drawings.

DETAILED DESCRIPTION

Figure 1A:
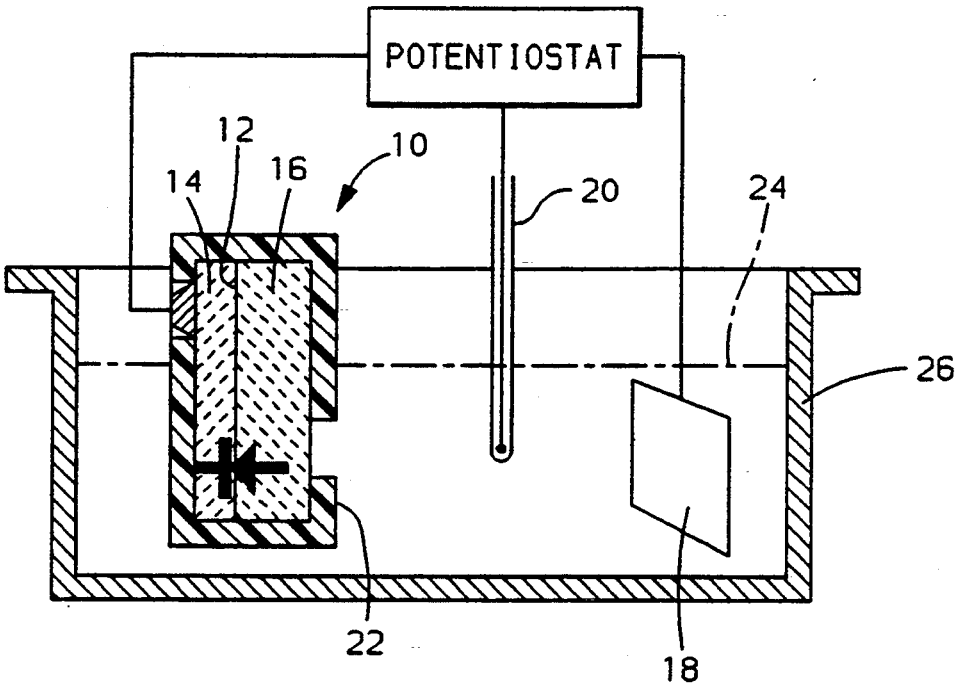
PRIOR ART FIG. 1A
FIG. 1A and 1B are schematic illustrations of prior three-electrode electrochemical etch systems.
Figure 1B:
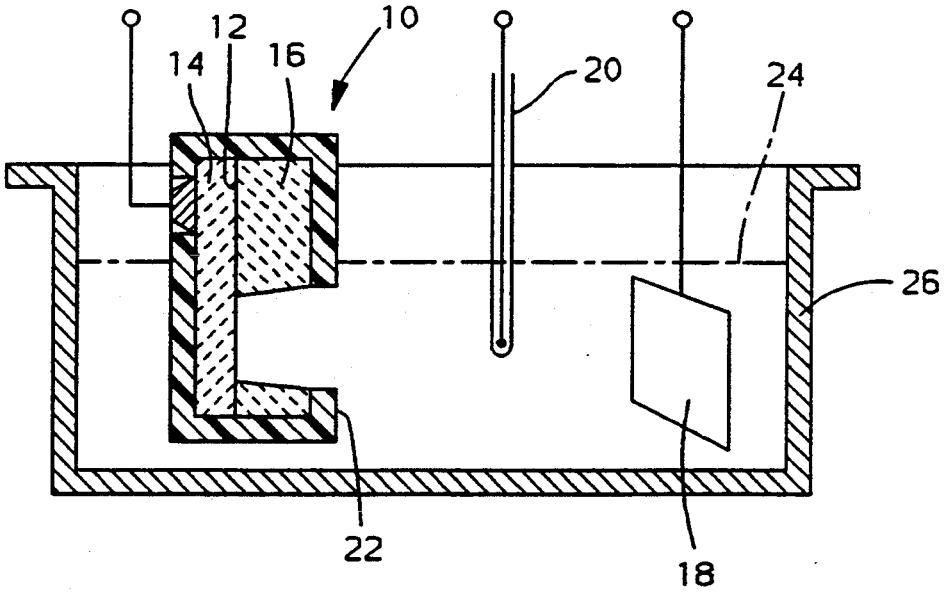
PRIOR ART FIG. 1B
Figure 2:
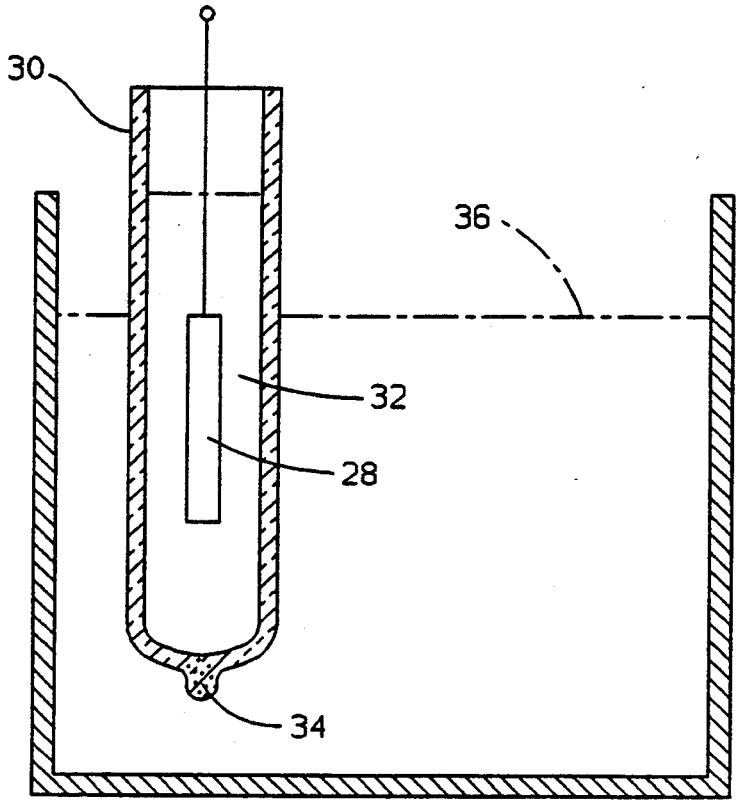
PRIOR ART FIG. 2
FIG. 2 illustrates a prior Ag/AgCl reference electrode immersed in an etchant.
Figure 3:
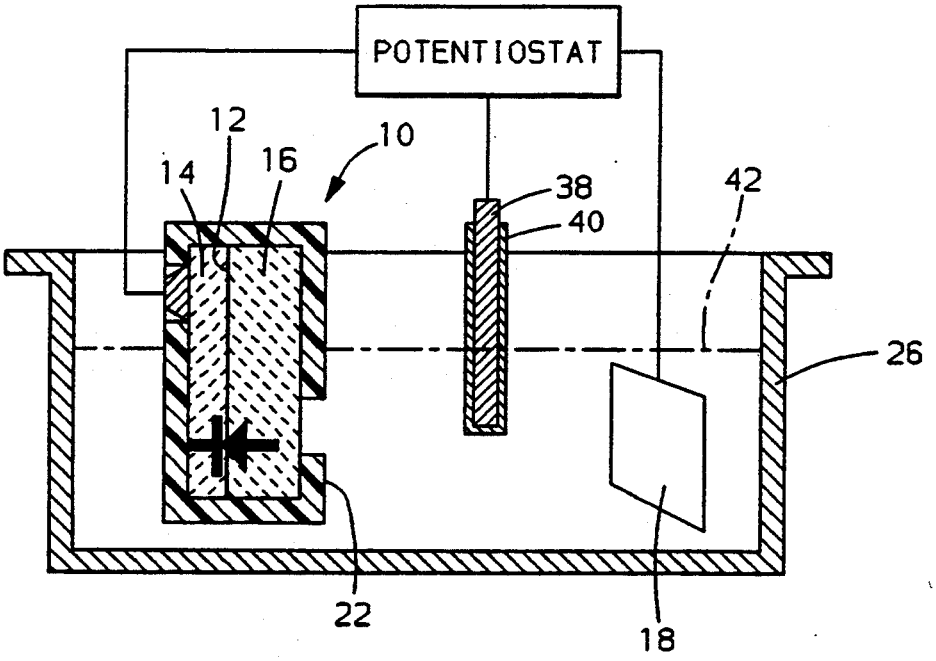
FIG. 3 illustrates an etch system including an $Ag/Ag_2O$ reference electrode immersed in an etchant according to the present invention.

It was determined that both silver and silver oxide ($Ag_2O$) are insoluble in caustic etchants, and neither of them is considered as a hazardous material. Therefore, if a reproducibly equilibrium potential can be established between silver and silver oxide in the caustic etchants, then this pair can be used as a reference electrode for the electrochemical etch-stop process. FIG. 3 illustrates the working principle of the electrochemical etch-stop technique of the present invention which shows the three-electrode etching configuration for fabricating silicon membranes. The three electrodes are: a (100) Si wafer working electrode 10 with a p-n junction 12 formed at the interface of a p-layer 14 and an n-layer 16, a platinum counterelectrode 18, and a reference electrode having a silver strip 38 covered with silver oxide 40 immersed in KOH etchant 42. The reference electrode should be relatively maintenance free. A mask 22 is selectively formed on the Si wafer. The electrodes are submerged in a wet etchant 24 within a container 26. A constant positive bias voltage is applied to the silicon wafer with respect to the reference electrode. Due to the presence of the reverse-bias junction, no current can flow to the p-layer and it will not be affected by the bias voltage. Therefore, the p-layer will be anisotropically etched.

A major challenge in using electrochemical etch-stop is to maintain the positive bias voltage applied to the silicon wafer sufficiently anodic to passivate the entire n-layer, so that the yield of this process can be maximized. In order to precisely control the amplitude of the positive bias voltage, a reference electrode is needed.

When a reference electrode is used in the electrochemical etch system, the potential difference between the silicon working electrode and the reference electrode is continuously measured and feedbacked to the control system (a potentiostat). No current is applied to the reference electrode so it does not become polarized. Therefore, the positive bias voltage applied to the silicon wafer can be precisely controlled.

Figure 4:
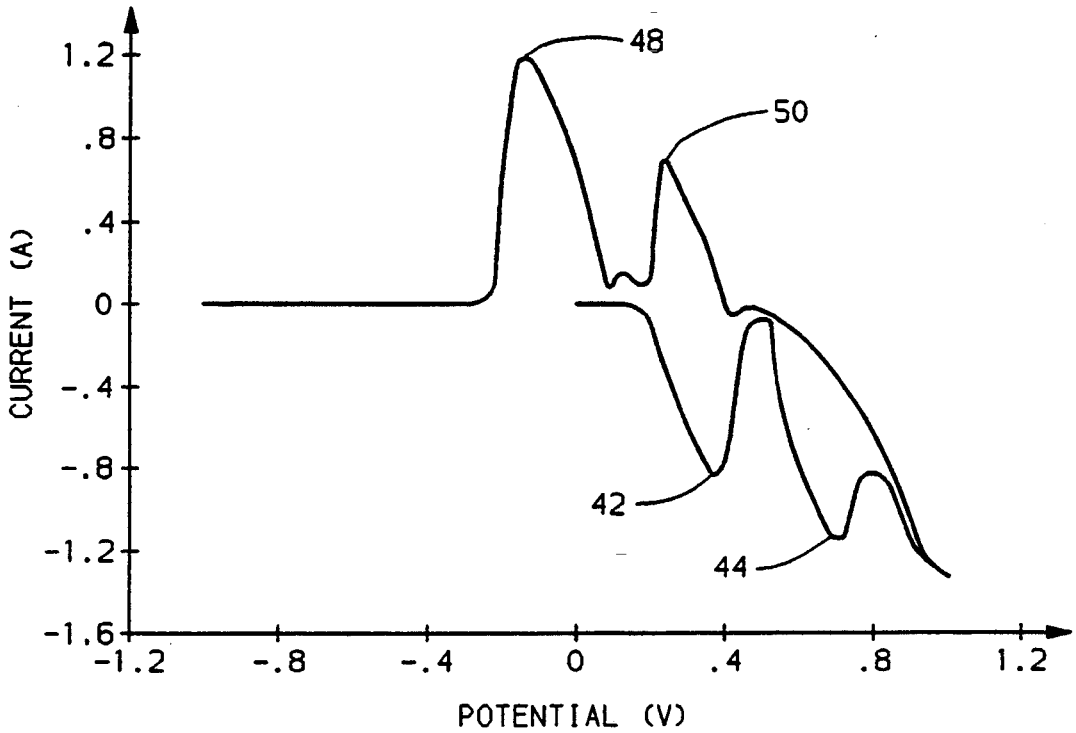
FIG. 4 is a cyclic voltammogram of silver in 20 weight percent KOH at 80° C., scan rate of 50 mV/sec.

The cyclic voltammogram obtained from a silver strip immersed in 20 weight percent KOH at 80° C. is shown in FIG. 4. The potential was measured between the silver strip and a commercial Ag/AgCl reference electrode. As the silver strip was scanned anodically, two different kinds of silver oxide, oxide I and II, were formed at anodic peaks 44 and 46 (FIG. 4). As the silver strip was scanned cathodically these two oxides dissolved at cathodic peaks 48 and 50, respectively. The equilibrium potential established between silver and the oxide I should be somewhere between the onset of anodic peak 44 and cathodic peak 48, i.e., between 0 and 0.2 V. As referring to the standard equilibrium potentials of metal/metal oxide pairs listed in Lange's Handbook of Chemistry, Chapter 6, silver and $Ag_2O$ can establish a equilibrium potential between 0 and 0.2 V. Therefore, oxide I is very likely to be $Ag_2O$. Similarly, the equilibrium potential established between silver and oxide II should be somewhere between 0.4 and 0.5 V, and oxide II is likely to be AgO.

The stability of these two oxides was also investigated. First, the silver strip was polarized either at 0.4 V (generating $Ag_2O$) or at 0.7 V (generating AgO) for sixty seconds in 20 weight percent KOH at 80° C. Then, the oxide covered silver strip was left standing in the solution, and the potential between the silver strip and a commercial Ag/AgCl reference electrode was monitored. It was found that after a long time standing, the measured potential always stabilized between −0.02 and 0.02 V regardless whether the silver strip was polarized at 0.4 or 0.7 V. If AgO is also stable in the KOH solution, the silver strip, polarized at 0.7 V, should reach a potential between 0.4 and 0.5, i.e., the equilibrium potential of silver and AgO. However, after polarizing at 0.7 V, the silver strip eventually stabilized at a potential very close to the equilibrium potential of silver and $Ag_2O$. This implies that AgO is not stable in the solution, and it gradually converts to $Ag_2O$. Therefore, on the $Ag/Ag_2O$ pair can establish a relatively stable equilibrium potential in the KOH solution.

The fluctuation of the potential between −0.02 and 0.02 V indicates that the $Ag/Ag_2O$ pair is not as stable as those commercial reference electrodes, such as Ag/AgCl and Hg/HgO. Therefore, $Ag/Ag_2O$ may not serve as a general purpose reference electrode. However, it should be stable enough for controlling the electrochemical etch-stop process.

Figure 5:
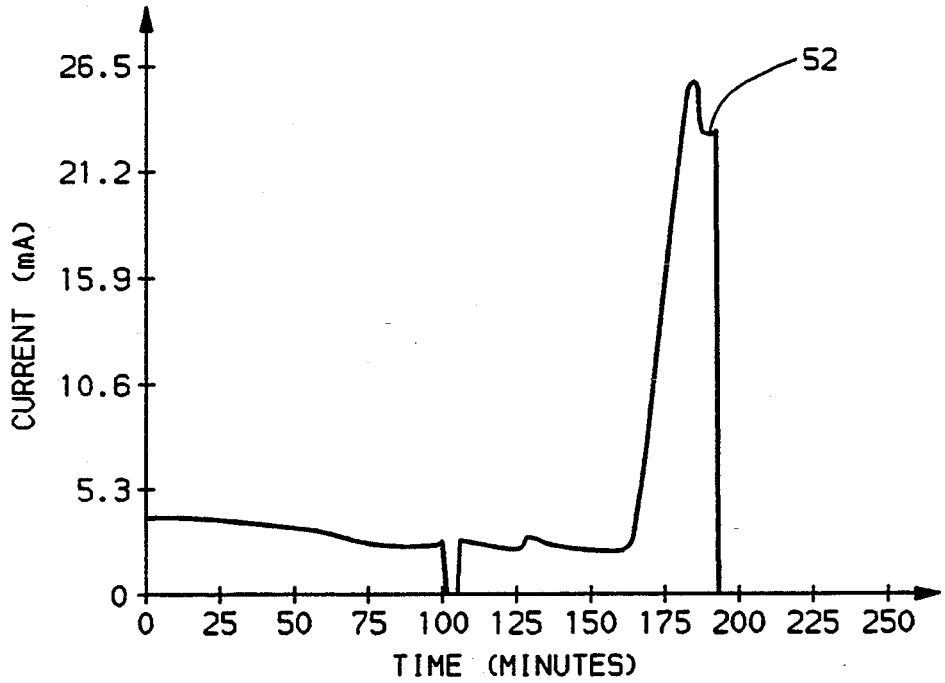
FIG. 5 is a graphic illustration of current versus time etch-stop curve for an etch system including a $Ag/Ag_2O$ reference electrode according to the present invention.

Two sample silicon wafers with p-n junctions were used for this demonstration. The etchant used was 20 weight percent KOH solution at 80° C. During the etching process, a constant positive bias of −0.2 V was applied between the silicon wafer and the reference electrode, and the current passing through the system was recorded versus time. One wafer was etched using a commercial Ag/AgCl reference electrode, and the other wafer was etched using a $Ag/Ag_2O$ reference electrode. The $Ag/Ag_2O$ reference electrode was prepared by polarizing a silver strip at 0.4 V for sixty seconds in 20 weight percent KOH at 80° C. The electrochemical etch-stop process worked successfully with the $Ag/Ag_2O$ reference electrode. The microstructures thus obtained were identical to those obtained using the commercial reference electrode. In addition, the current versus time curve obtained using the $Ag/Ag_2O$ reference electrode (see FIG. 5) is similar to that obtained using the commercial reference electrode. The peak B2 in FIG. 5 corresponds to the etch-stop point.

The reference electrode according to the present invention include a core consisting essentially of silver and an outer layer consisting essentially of $Ag_2O$ surrounding the core. $Ag/Ag_2O$ reference electrode is prepared by polarizing a silver strip at less than 0.4 V for more than sixty seconds in KOH etchant (or other etchants). $Ag/Ag_2O$ reference electrode can be reconditioned in-situ, i.e., in the etchant, anytime if there is a need using the same method as that described above. The $Ag/Ag_2O$ reference electrode can be used in various anisotropic etchants, such as NaOH, CsOH, $NH_4OH$, ethylenediamine pyrocatechol, and hydrazine. The concentration and processing temperature of the etchants can vary within a wide range.

The embodiments of the invention in which an exclusive property or privilege is claimed as defined as follows:

1. A method of wet electrochemical etching comprising:

providing an etchant solution;

providing a working electrode comprising silicon being selectively masked and having a p-n junction, a counterelectrode and a reference electrode in contact with the anisotropic etchant solution;

said reference electrode comprising an Ag layer and an $Ag_2O$ layer;

applying a positive bias voltage to the working electrode to selectively etch the same; and measuring the potential between the working electrode and the reference electrode, and selectively adjusting the voltage applied to the working electrode as a function of the measured potential.

2. The method described in claim 1, wherein the etchant solution comprises KOH.

3. The method described in claim 2, wherein the etchant solution is about 20 percent by weight KOH.

4. The method described in claim 1, wherein the etchant solution comprises an anisotropic etchant selected from a group of NaOH, CsOH, $NH_4OH$, ethylenediamine pyrocatechol, and hydrazine.

5. The method as described in claim 1, wherein said reference electrode is formed by applying a positive potential of less than 0.4 volts for more than 60 seconds to a strip of silver in the etchant solution to form an over layer of $Ag_2O$.

6. The method described in claim 1, wherein the reference electrode can be reconditioned during the electrochemical etching by polarizing the reference electrode by applying a positive potential of less than 0.4 volts for more than 60 seconds while the reference electrode is in the etchant solution.

* * * * *